United States Patent [19]

Box

[11] Patent Number: 4,819,822

[45] Date of Patent: Apr. 11, 1989

[54] PILFER RESISTANT BEVERAGE CASE

[75] Inventor: Thomas Box, Shrewsbury, N.J.

[73] Assignee: Spectrum International, Inc., Tinton Falls, N.J.

[21] Appl. No.: 139,624

[22] Filed: Dec. 30, 1987

[51] Int. Cl.[4] ..... B65D 21/02

[52] U.S. Cl. ..... 220/72; 220/DIG. 15; 206/509; D34/40

[58] Field of Search ..... 220/72, 74, 83, DIG. 15; 206/509, 511, 512; D34/40

[56] References Cited

U.S. PATENT DOCUMENTS

| | | | |
|---|---|---|---|
| D. 242,600 | 12/1976 | Box . | |
| D. 245,760 | 9/1977 | Box . | |
| D. 258,803 | 4/1981 | Box . | |
| D. 259,294 | 5/1981 | Box . | |
| D. 261,194 | 10/1981 | Box . | |
| D. 265,009 | 6/1982 | Box . | |
| D. 266,709 | 10/1982 | Box . | |
| 3,361,293 | 1/1968 | Box . | |
| 3,392,875 | 7/1968 | Bockenstette . | |
| 3,425,594 | 2/1969 | Bridenstine . | |
| 3,568,879 | 3/1971 | Box . | |
| 3,628,684 | 12/1971 | Sere | 220/72 X |
| 3,655,088 | 4/1972 | Box . | |
| 3,659,743 | 5/1972 | Box . | |
| 3,675,815 | 7/1972 | Rehrig . | |
| 3,682,351 | 8/1972 | De Putter . | |
| 3,809,279 | 5/1974 | Arjas | 220/DIG. 15 X |
| 3,997,055 | 12/1976 | Box . | |
| 3,998,327 | 12/1976 | Box . | |
| 3,998,328 | 12/1976 | Box . | |
| 4,176,747 | 12/1979 | Aho | 220/DIG. 15 X |
| 4,190,172 | 2/1980 | Box . | |
| 4,194,626 | 3/1980 | Boller | 206/509 |
| 4,197,958 | 4/1980 | Zeni et al. | 220/72 |
| 4,320,845 | 3/1982 | Waller . | |
| 4,441,615 | 4/1984 | Goodrich . | |
| 4,478,156 | 10/1984 | Andersson . | |
| 4,548,320 | 10/1985 | Box . | |
| 4,597,503 | 7/1986 | Lates | 220/83 |

FOREIGN PATENT DOCUMENTS

| | | |
|---|---|---|
| 2805880 | 2/1979 | Fed. Rep. of Germany . |
| 1512202 | 1/1968 | France . |

*Primary Examiner*—Steven M. Pollard

*Attorney, Agent, or Firm*—Hedman, Gibson, Costigan & Hoare

[57] ABSTRACT

A beverage case is provided with two longitudinal and two lateral sides formed with enlarged central openings that will not serve to contain or confine articles smaller then milk cartons or beverage bottles. Further, the beverage case of the invention is provided with a reinforcing rib structure to react the forces imposed on the beverage case generally and in particular, the forces that, to an extent, have been previously reacted by full sides.

9 Claims, 5 Drawing Sheets

PILFER RESISTANT BEVERAGE CASE

FIELD OF THE INVENTION

This invention relates to beverage cases for accommodating cartons of milk or similar items during transfer and on-site storage. More particularly, the invention relates to a durable beverage case designed and configured to discourage pilferage of the beverage case.

BACKGROUND OF THE INVENTION

Beverage cases have been used for many years for the delivery of beverages and particularly milk. At first the cases were made of wood or wood and metal. More recently, beverage cases of plastic have become common and in many locations have made the wooden or wooden and metal cases obsolete.

It has always been necessary for the beverage cases to be of strong, sturdy construction to accommodate the weight of the full beverage containers and to withstand the forces imposed on the beverage cases during handling and transportation.

The plastic beverage cases are typically formed in one integral piece, customarily by injection molding. The usual material is polyethylene. Thus, a sturdy lightweight beverage case is formed that is durable.

The plastic beverage cases, probably because of the lightweight sturdy construction, have been put to use for just about every conceivable storage use by the public. Many of the users simply appropriate the plastic beverage cases from the dairy or store in which the beverage cases are found.

SUMMARY OF THE INVENTION

It is an object of the present invention to provide a plastic beverage case that will be less susceptible to pilferage.

It is another object of the present invention to provide a plastic beverage case that is uniquely suited for accommodating beverage containers such as bottles or cartons but not other items.

A still further object of the subject invention is to provide a beverage case that includes the minimum of side wall material necessary to accommodate beverage bottles or containers, but with sufficient structural capacity to withstand the forces typically imposed on beverage cases during storage, transport and general handling.

In accordance with the objects of the present invention, a beverage case is provided with two longitudinal and two lateral sides formed with enlarged central openings that will not serve to contain or confine articles smaller than milk cartons or beverage bottles. Further, the beverage case of the invention is provided with a reinforcing rib structure to react the forces imposed on the beverage case generally and, in particular, the forces that, to an extent, had been previously reacted by full wall sides.

DESCRIPTION OF THE DRAWINGS

The invention will be better understood when considered with the following drawings wherein.

DESCRIPTION OF THE PREFERRED EMBODIMENT

Figure 1:
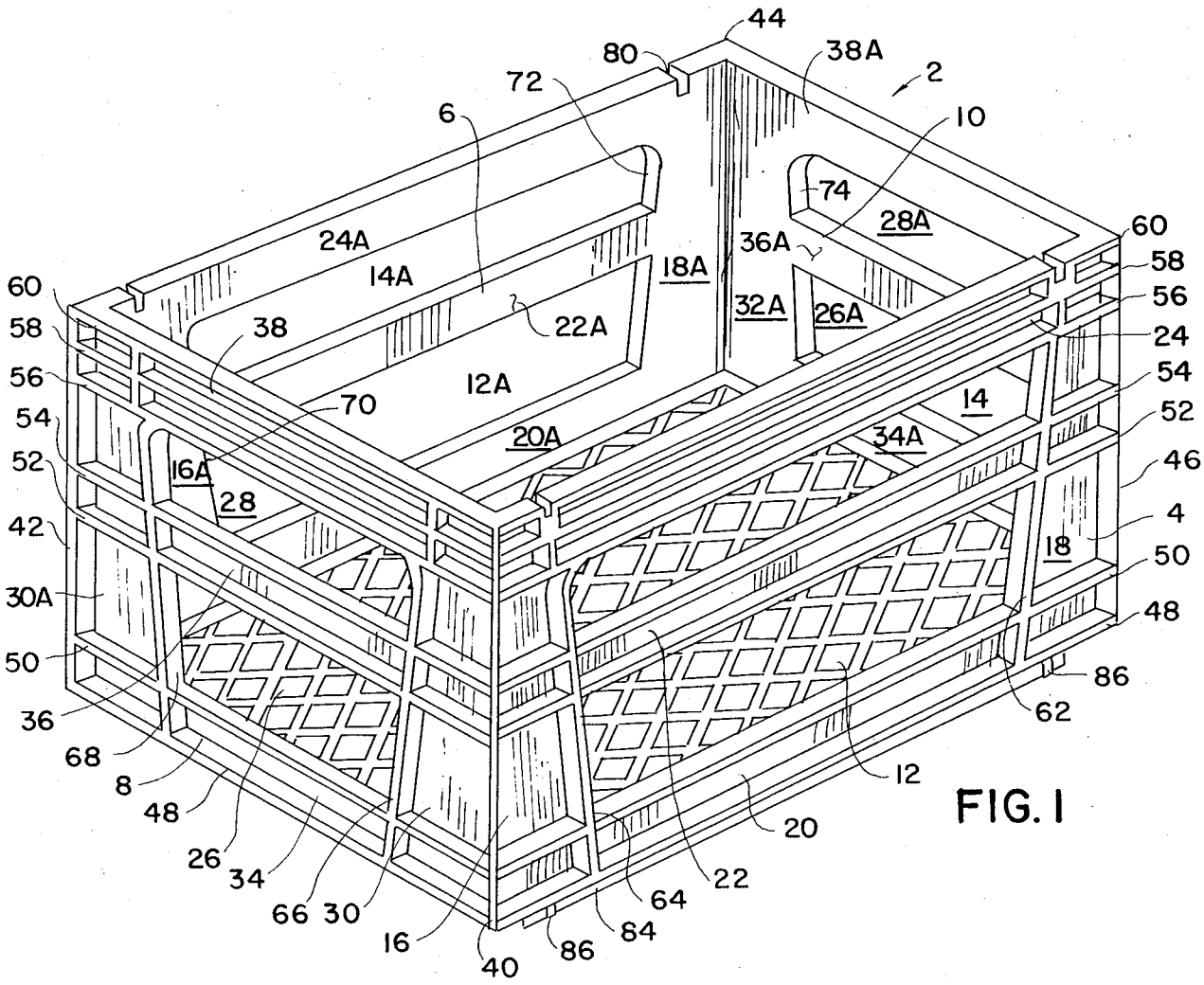
FIG. 1 is an isometric view of the beverage case of the invention.

The beverage case 2 of the present invention is illustrated as a rectangular beverage case configured to accommodate twelve (12) one-half gallon milk cartons, six (6) one gallon containers, twenty-four (24) quart or seventy-two (72) half-pint containers. However, the structure can be used in beverage cases having virtually any configuration or dimensions.

Figure 2:
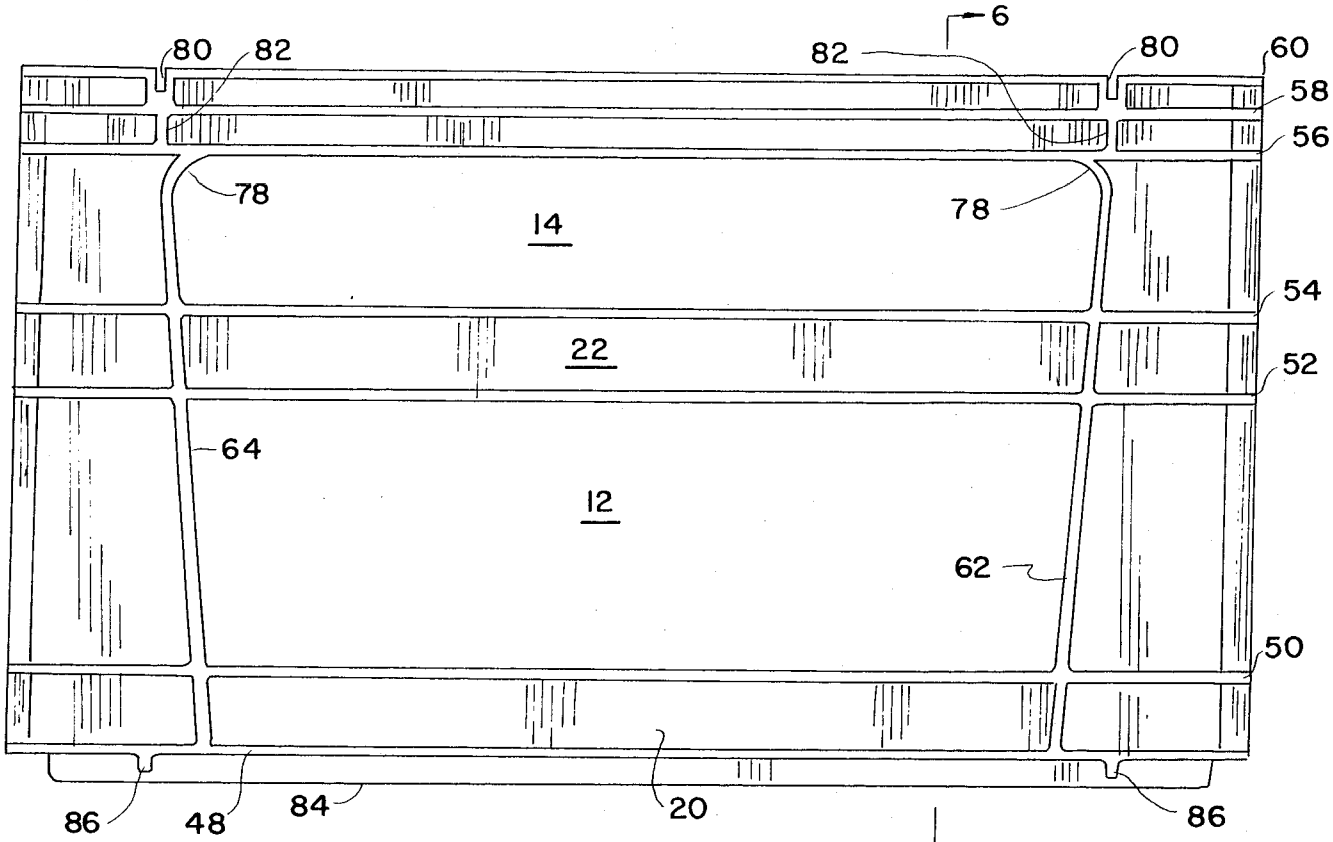
FIG. 2 is a side elevational view of the longitudinal side of the beverage case of FIG. 1.
Figure 3:
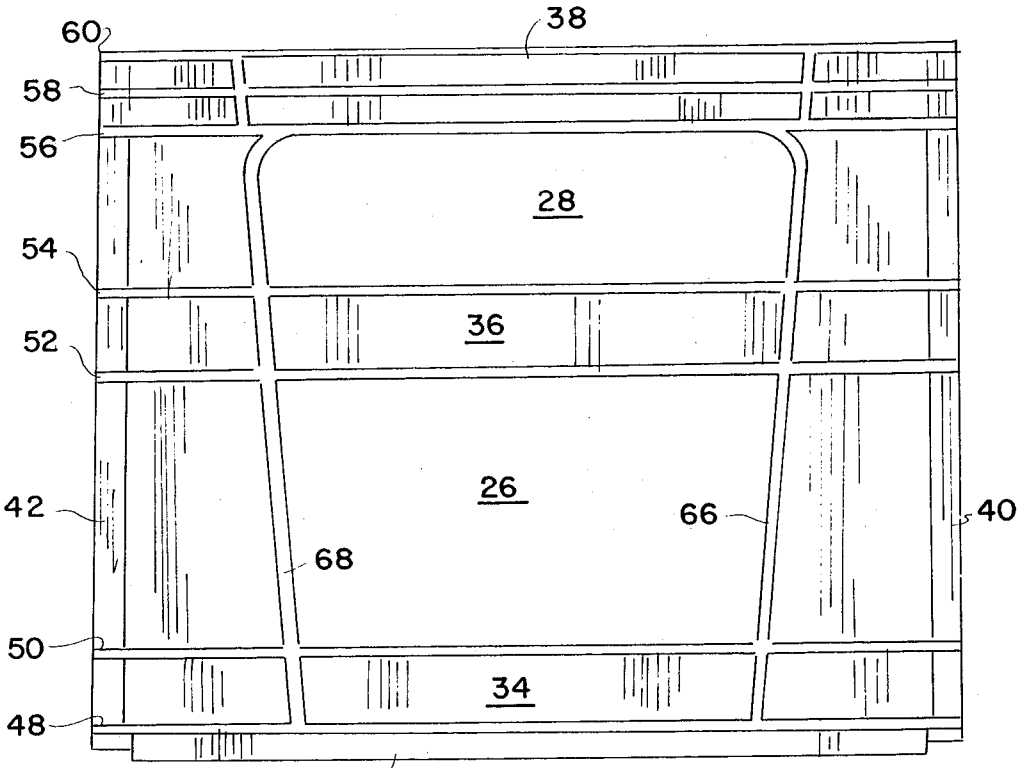
FIG. 3 is a side elevational view of a lateral side of the beverage case of FIG. 1.

As best seen in FIGS. 1 and 2, the beverage case is provided with two longitudinal sides 4 and 6 and two lateral sides 8 and 10. Each longitudinal side 4 and 6 is similarly configured with a lower opening 12, 12A and an upper opening 14, 14A dominating the side. Each longitudinal side has solid end panels 16, 16A and 18, 18A, lower horizontal panels 20, 20A, intermediate horizontal panels 22, 22A and upper horizontal panels 24, 24A.

Similarly, the lateral sides 8 and 10 are configured the same with a lower opening 26, 26A and an upper opening 28, 28A. The lateral sides 8 and 10 also have solid end panels 30, 30A and 32, 32A, lower horizontal panels 34, 34A, intermediate horizontal panels 36, 36A and upper horizontal panels 38, 38A.

The solid end panels 16, 16A, 18, 18A of the longitudinal sides 4 and 6 are integrally formed with respective solid end panels 30, 30A, 32, 32A of the lateral sides 8 and 10 to provide four solid corner members.

The vertical edges of the openings 12 and 14 and 12A and 14A are inclined at an angle of about 5° to the vertical. Similarly, the vertical edges of the openings 26 and 28 and 26A and 28A are inclined at about the same angle of 5° to the vertical. The openings 14, 14A, 28 and 28A terminate at the top in an inwardly extending radius.

Figure 6:
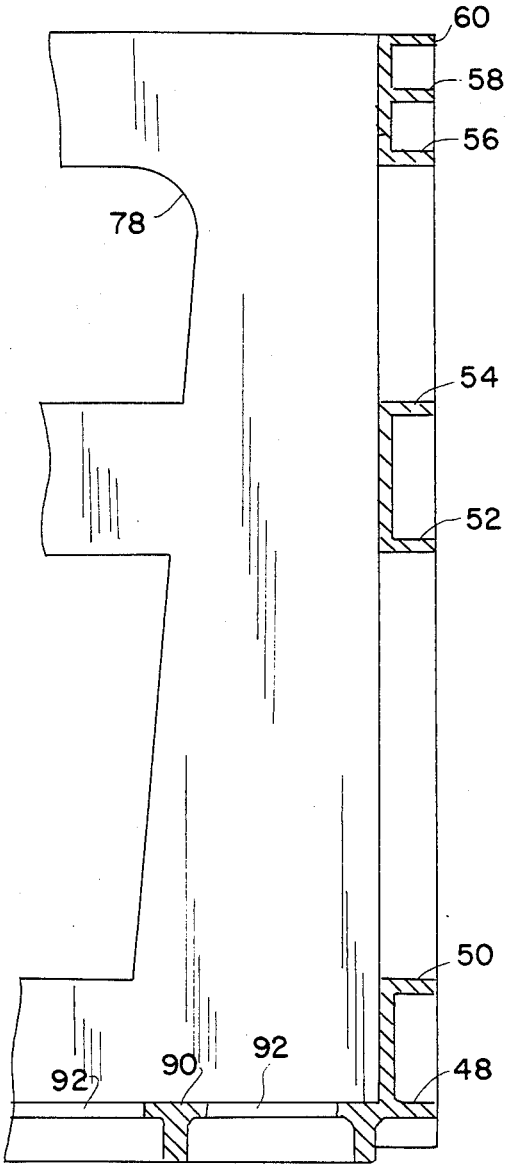
FIG. 6 is a sectional elevational view taken through line 6—6 of FIG. 2.
Figure 7:
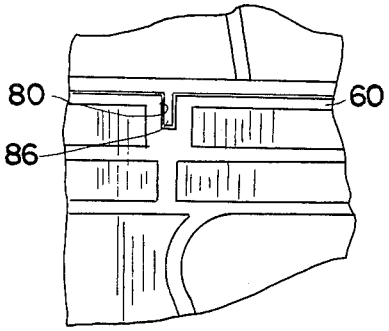
FIG. 7 is an enlarged partial elevational view of a top recess and reinforcement rib at the radius of the top of an upper opening.

The beverage case 2 is provided with a rib structure or girdle, best seen in FIGS. 1 and 6, to afford the durability and strength required for beverage cases The rib structure is integrally formed with the panel sections of the beverage case. The rib structure is comprised of four vertical ribs 40, 42, 44 and 46 extending diagonally from each corner of the beverage case 2, two horizontal lower ribs 48 and 50, two horizontal intermediate ribs 52 and 54 and three horizontal upper ribs 56, 58 and 60; the horizontal ribs are continuously formed around the beverage case 2. In addition, eight ribs 62, 64, 66, 68, 70, 72, 74 and 76 extend along the respective vertical edges of the openings in the longitudinal and lateral sides of the beverage case 2. Illustratively, edge ribs 62 and 64 are seen in FIG. 2 extending from the bottom horizontal rib 48 along the vertical edge of the openings 12 and 14 to the lowest rib 56 of the three horizontal upper ribs and are provided with an upper radius section 78 to follow the edge of the upper opening 14 as seen also in FIG. 7.

The vertical ribs 66, 68, 70, 72, 74 and 76 are formed along the edges of the respective openings 12A-14A; 26-28 and 26A-28A in the same manner as vertical ribs 62 and 64.

In the embodiment of the rectangular beverage case 2 herein described and configured to accommodate six (6) one gallon milk cartons or seventy-two half-pint cartons, the lower longitudinal side openings 12 and 12A are $4\frac{5}{8}$ to $4\frac{3}{4}$ inches high and $12\frac{7}{8}$ to 13 inches wide at the bottom (at ribs 50) and $13\frac{1}{2}$ to $13\frac{5}{8}$ inches wide at the top (at rib 52). The upper longitudinal side openings 14 and 14A are $2\frac{1}{4}$ to $2\frac{3}{8}$ inches high and $13\frac{7}{8}$ to 14 inches wide at the bottom (at rib 54) and 14 3/16 to 14 5/16 inches wide at the maximum width where the radius 78 begins.

The lower lateral side openings 26 and 26A are $4\frac{5}{8}$ to $4\frac{3}{4}$ inches high and $7\frac{1}{8}$ to $7\frac{1}{4}$ inches wide at the bottom (at rib 50) and $7\frac{5}{8}$ to $7\frac{3}{4}$ inches wide at the top (at rib 52). The upper lateral side openings 28 and 28A are $2\frac{1}{4}$ to $2\frac{3}{8}$ inches high and $8\frac{3}{8}$ to $8\frac{1}{4}$ inches wide at the bottom (at rib 54) and $8\frac{3}{8}$ to $8\frac{1}{2}$ inches wide at the maximum width where the radius 78 begins.

In order to be able to stack three (3) tiers of one-half pint cartons, it is imperative that the opening 26 and 26A is no higher than 1 to $1\frac{1}{4}$ inches from the inside floor to longitudinal rib 50 and $4\frac{5}{8}$ to $4\frac{3}{4}$ inches from the inside floor to longitudinal rib 52 and 6 $\frac{3}{4}$ to $6\frac{7}{8}$ inches from the inside floor to longitudinal rib 54 and $9\frac{1}{8}$ to $9\frac{1}{4}$ inches from the inside floor to longitudinal rib 56.

Figure 4:
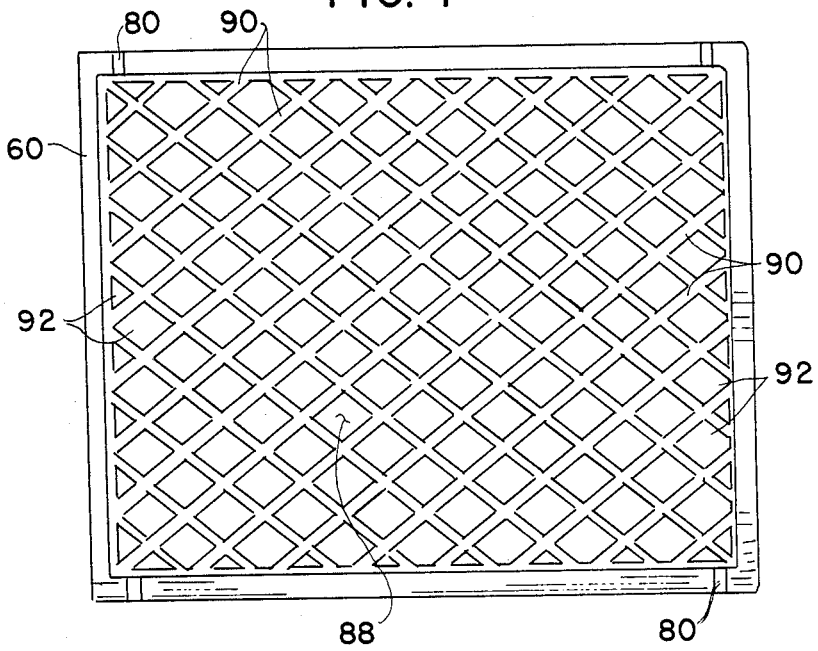
FIG. 4 is a top plan view of the beverage case of FIG. 1.

The top of the beverage case 2, best seen in FIG. 4, is the flat surface of the upper continuous rib 60 in which are formed four recesses 80. As seen in FIG. 1, the recesses 80 are formed in the rib 60 with two recesses on each longitudinal side. Directly below each recess 80 is a short vertical rib 82 that extends between the horizontal ribs 56 and 58.

Figure 5:
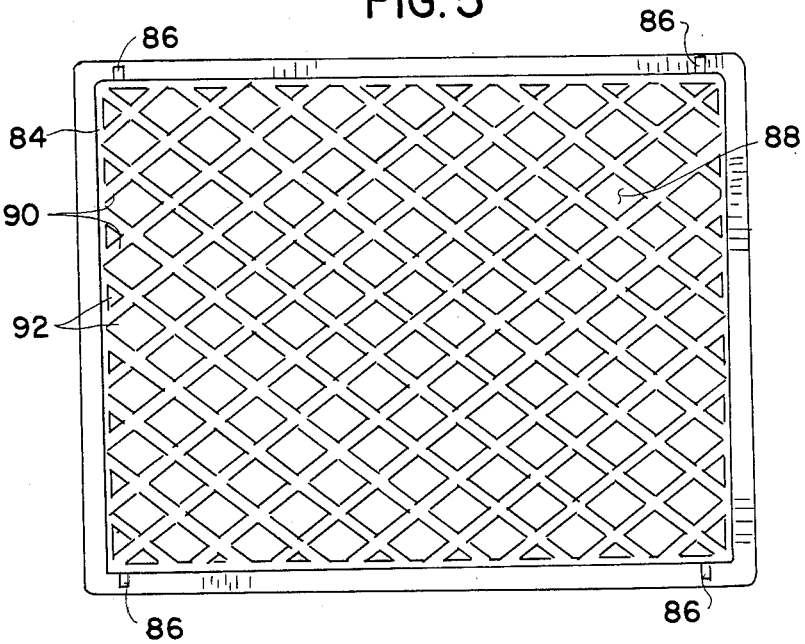
FIG. 5 is a plan view of the beverage case taken from the bottom.

The bottom of the beverage case 2, best seen in FIG. 5, is essentially the lower surface of the bottom horizontal rib 48 with a stacking ring 84 depending downwardly from the inner edge of the rib 48. The stacking ring 84 is configured to fit within the inner periphery of the upper rib 60 of a similarly configured beverage case 2 when the beverage cases 2 are stacked. Protrusions 86 extends from the bottom of the horizontal rib 48 on the longitudinal sides 4 and 6 of the beverage case 2 in alignment with the recesses 80 in the upper rib 60.

In the stacked mode, the protrusions 86 fit within the recesses 80 of a similarly configured beverage case 2, and in combination with the stacking ring 84 securely maintain the beverage cases 2 in a stacked column.

As best seen in FIGS. 4 and 5, the bottom floor 88 of the beverage case is formed in a mesh-like configuration with diagonally extending members 90 defining openings 92.

The configuration of side wall openings and rib structure provides a structurally sound beverage case particularly well suited for accommodating beverage containers, but of little use for items not similarly sized.

I claim:

1. A beverage case for holding a plurality of bottles and cartons comprising:

two longitudinal sides having a lower solid horizontal panel, an intermediate solid horizontal panel, an upper solid horizontal panel, two solid vertical end panels and lower and upper openings defined by the solid horizontal panels and solid vertical end panels;

two lateral sides each having a lower solid horizontal panel, an intermediate solid horizontal panel, an upper solid horizontal panel, two solid vertical end panels and lower and upper openings defined by the solid horizontal panels and solid vertical end panels; and a rib structure surrounding the solid horizontal and vertical end panels and which are integrally formed with the solid horizontal and vertical end panels.

2. A beverage case as in claim 1 wherein the rib structure is comprised of two continuous lower horizontal ribs, two continuous intermediate horizontal ribs and three continuous upper horizontal ribs surrounding the lower, intermediate and upper solid panels and four vertical ribs at each corner extending diagonally from the corner said corner formed by the solid vertical end panels.

3. A beverage case as in claim 2 wherein the openings in the longitudinal and lateral sides are formed with vertical edges that are at about a 5° angle to the vertical and further comprising ribs integrally formed with the vertical end panels that are located along the vertical edge of each opening.

4. A beverage case as in claim 3 further comprising a radius following the top of each vertical edge of each upper opening.

5. A beverage case as in claim 4 wherein the rib structure is comprised of two continuous horizontal ribs surrounding the lower horizontal panels, one of said ribs being located at the bottom of the beverage case, two continuous horizontal ribs surrounding the intermediate panels and three continuous horizontal ribs surrounding the upper panels, one of said ribs being located at the top of the beverage case.

6. A beverage case as in claim 5 further comprising two recesses in the top of the top rib, a short vertical rib below each recess extending from the top rib to the continuous horizontal rib below the top rib, said short vertical ribs being integrally formed with the rib structure and four protrusions depending from the bottom rib of the beverage case and being aligned with the recesses and sized to fit within the recesses of an identically configured beverage box.

7. A beverage case as in claim 6 further comprising a stacking ring depending downwardly from the bottom of the beverage case, said stacking ring sized to fit within the contour of the inner peripheral edge of the upper rib forming the top of a similarly configured beverage case.

8. A beverage case as in claim 7 having a bottom support surface formed in a mesh pattern that defines a plurality of holes.

9. A beverage case as in claim 1 wherein the width of the intermediate solid horizontal panel in the longitudinal and lateral sides begins about 4-$\frac{5}{8}$ to 4-$\frac{3}{4}$ inches from the inside floor and ends about 6-$\frac{3}{4}$ to 6-$\frac{7}{8}$ inches from the inside floor.

* * * * *